United States Patent [19]

Patel

[11] 4,118,970

[45] Oct. 10, 1978

[54] CRIMPING DIAMETER ADJUSTING VALVE

[75] Inventor: Hiralal V. Patel, Euclid, Ohio

[73] Assignee: The Weatherhead Company, Cleveland, Ohio

[21] Appl. No.: 813,534

[22] Filed: Jul. 7, 1977

[51] Int. Cl.[2] ..... B21J 9/12

[52] U.S. Cl. ..... 72/402; 72/441; 91/410

[58] Field of Search ..... 72/402, 32, 35, 441; 91/410, 392

[56] References Cited

U.S. PATENT DOCUMENTS

| | | | |
|---|---|---|---|
| 3,534,661 | 10/1970 | Hettlinger | 91/410 |
| 3,568,494 | 3/1971 | Geisman | 72/402 |
| 3,742,754 | 7/1973 | Jeromson | 29/237 |

FOREIGN PATENT DOCUMENTS

| | | | |
|---|---|---|---|
| 2,229,479 | 12/1974 | France | 72/402 |

*Primary Examiner*—Milton S. Mehr
*Assistant Examiner*—Gene P. Crosby
*Attorney, Agent, or Firm*—McNenny, Pearne, Gordon, Gail, Dickinson & Schiller

[57] ABSTRACT

A crimping machine for crimping a metal end fitting onto a flexible hose includes a stationary socket, a crimping die arranged in the socket for axial movement, and a hydraulic actuator. A valve member is provided in a fluid flow passage leading from a pump to the actuator. The distance between the valve member and a piston of the actuator is precisely controlled to control the axial movement of the crimping die relative to the socket.

8 Claims, 3 Drawing Figures

CRIMPING DIAMETER ADJUSTING VALVE

BACKGROUND AND SUMMARY OF THE INVENTION

A wide variety of crimping machines for radially deforming a metal end fitting to permanently secure the end fitting onto a flexible hose has been provided by the prior art. One such prior art crimping machine is disclosed in U.S. Pat. No. 3,742,754. This prior art machine uses a hydraulic ram or piston which acts on a gaging plate to push a multiple segment crimping die into a conical socket. The gaging plate shown in this prior art patent is reversible to change the amount of axial movement of the multiple segment die relative to its associated socket.

The present invention departs from prior art crimping machines and provides a crimping machine which includes a stationary socket and a crimping die which is moved axially relative to the socket to crimp a workpiece. A hydraulic actuator for moving the crimping die relative to the socket includes a cylinder, an end plate closing one end of the cylinder, and a piston slidable within the cylinder. The cylinder and end plate and piston cooperatively define a variable volume pressure chamber.

A hydraulic pump provides a source of fluid power for the crimping machine, and a passage in the end plate connects the pump to the pressure chamber. A valve member in the passage is movable between an open position opening the passage and a closed position closing the passage.

A mechanical connecting rod is rigidly secured at one end to the valve member and is adjustably secured at the other end to the piston. By this arrangement, movement of the piston in a direction away from the end plate moves the valve member toward its closed position to close the passage.

The connecting rod is threadably secured to the piston so that rotation of the connecting rod changes the distance between the valve member and the piston. This changes the position of the piston at which advancing movement of the piston is terminated by closing fluid flow from the pump through the passage to the pressure chamber.

A valve stem is provided for rotatably adjusting the connecting rod relative to the piston. A pivotal connection is provided between the stem and the valve member, so that the valve member will properly seat in the passage even if the stem is not precisely aligned with the valve member and connecting member. A one way check valve provided in the valving member permits reduction of fluid pressure in the pressure chamber when the piston is to be retracted.

BRIEF DESCRIPTION OF THE DRAWINGS

These and other aspects and advantages of the present invention are shown in the preferred embodiment of the invention illustrated in the accompanying drawings, wherein.

DETAILED DESCRIPTION OF THE DRAWINGS

Figures 1, 2, 3:
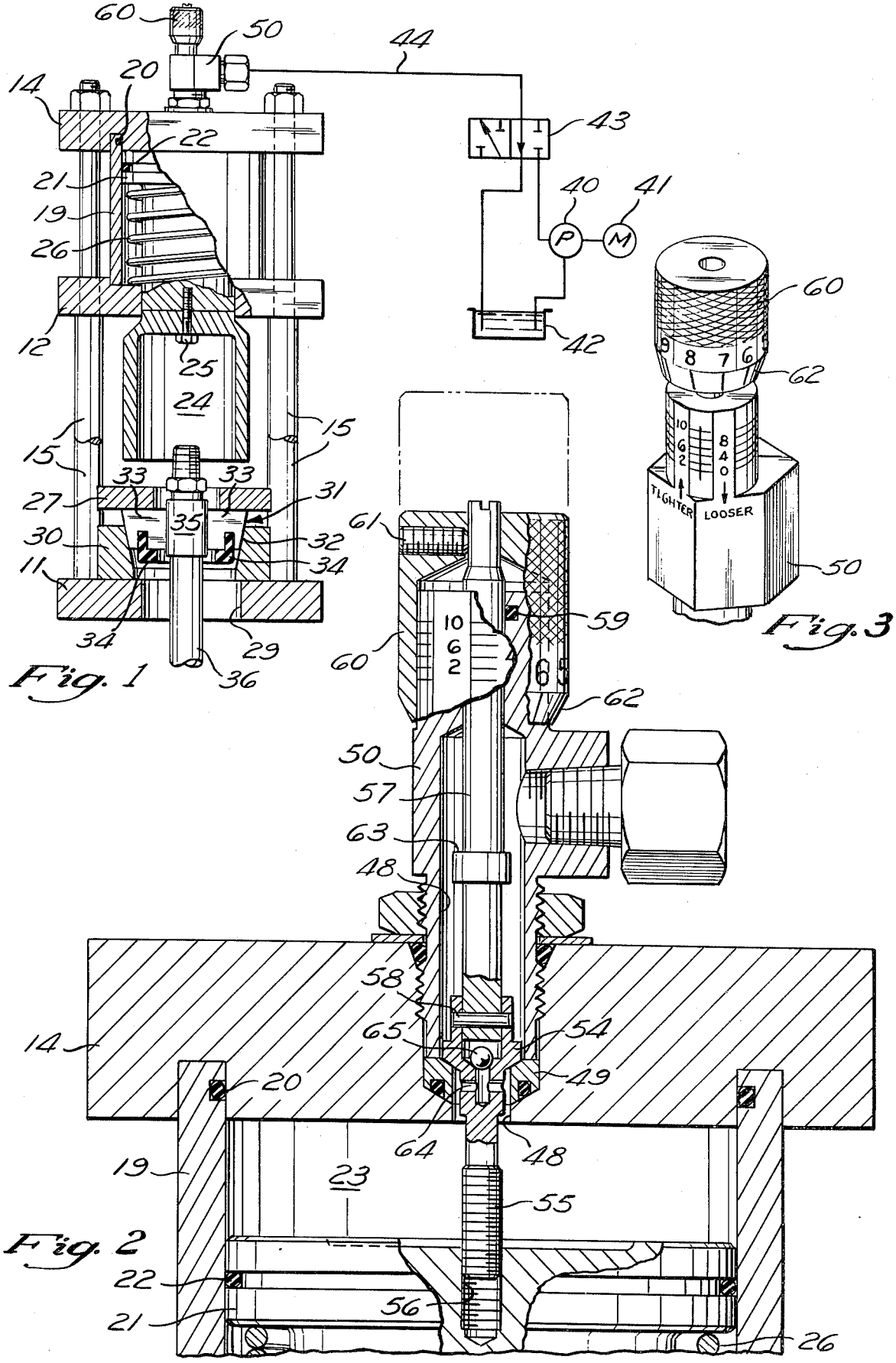
FIG. 1 is a front elevational view of a crimping machine according to the principles of the invention, with portions shown in cross section and with the piston in a retracted position.
FIG. 2 is an enlarged fragmentary cross sectional view of a portion of the crimping machine shown in FIG. 1, but with the piston shown in an advanced position.
FIG. 3 is an enlarged exploded perspective view of a portion of the crimping machine shown in FIG. 1.

Referring now to the drawings in greater detail, FIG. 1 shows a crimping machine which includes a bed plate 11, a lower cylinder end plate 12, and an upper cylinder end plate 14. The plates 11, 12 and 14 are each generally flat rectangular plates. Four tension rods 15 are disposed at the four corners of the rectangular plates 11, 12 and 14. The tension rods 15 are each stepped to provide a larger diameter portion between the bed plate 11 and the lower end plate 12 and a smaller diameter portion between the lower end plate 12 and the upper end plate 14. Alternatively, the rods 15 may be of uniform diameter and may be fitted with a suitable collar between the bed plate 11 and the lower end plate 12 to maintain the proper spacing therebetween.

A cylinder 19 is disposed between the end plates 12 and 14. An elastomeric seal 20 prevents fluid leakage between the cylinder 19 and the upper end plate 14. A cylindrical ram or piston 21 is slidably disposed in the cylinder 19. Fluid leakage between the piston 21 and cylinder 19 is prevented by an elastomeric seal 22. The upper end plate 14 and cylinder 19 and ram 21 cooperatively define a variable volume fluid pressure chamber 23.

An inverted cup shaped cylindrical pusher member 24 is secured to the bottom end of the piston 21 by a suitable bolt 25. The pusher member 24 is preferably provided with a longitudinal slot (not shown) extending upwardly from its open end to permit a fitting which is to be crimped to slide on the bed plate 11 laterally into and out of the pusher member 24. This slot in the side wall of the pusher member 24 is disclosed in U.S. Pat. No. 3,742,754. A coil spring 26 acts between the lower end plate 12 and the piston 21 to return the piston 21 to a fully retracted position shown in FIG. 1 when pressure is released in the chamber 23.

Still referring to FIG. 1, the bed plate 11 is provided with a slot 29 extending laterally rearwardly from the front edge of the bed plate 11. This arrangement of the slot 29 is also shown in the above referenced U.S. Pat. No. 3,742,754. A conical socket 30 is slidably disposed on the bed plate 11 and is axially aligned with the piston 21 and the pusher member 24 and slot 29.

A crimping die 31 having a conical outer peripheral surface 32 is received in the socket 30. The crimping die 31, as disclosed in U.S. Pat. No. 3,750,452, includes a plurality of die segments 33 which are biased to a free radially outward position shown in FIG. 1 by a resilient spacer material 34. A removable flat annular ring 27 rests on top of the crimping die 31 to transmit force between the pusher member 24 and each of the segments 33 of the crimping die 31.

A metal hose end fitting 35 is assemblied on one end of a flexible hose 36. The end fitting 35 is placed in the crimping die 31 in the manner shown in FIG. 1 when the end fitting 35 is to be radially inwardly deformed or crimped to fasten the end fitting 35 onto the end of the hose 36.

Still referring to FIG. 1, a pump 40 driven by an electric motor 41 is arranged to supply fluid from a reservoir 42 to a valve 43. A hydraulic line 44 connects the valve 43 to a fluid passage leading to the chamber 23 as described below.

Referring now to FIG. 2, a fluid passage 48 extends axially completely through the upper end plate 14 to supply fluid to and exhaust fluid from the chamber 23. A replaceable valve seat 49 is secured in the passage 48 by a housing 50 which is threadably secured in the passage 48.

A valve member 54 is disposed in the passage 48 for movement toward and away from the valve seat 49 to close and open the passage 48. A connecting rod or pin 55 is formed integrally with the valve member 54 and extends downwardly from the valve member 54 to a threaded lower portion which is threadably received in a threaded hole 56 extending from the top surface of the piston 21. By this arrangement, the valve member 54 is secured to the piston 21 for axial reciprocating movement with the piston 21 under all conditions.

A cylindrical valve stem 57 extends upwardly from the valve member 54 through the passage 48. The lower end of the valve stem 57 is pivotally connected to the valve member 54 by a pin 58 which extends through aligned holes in the valve member 54 and valve stem 57. The top of the passage 48 in the housing 50 is provided with an elastomeric O-ring seal 59 which engages the top of the valve stem 57 to prevent fluid leakage between the housing 50 and the valve stem 57.

An inverted cup-shaped thimble 60 is secured to the top of the valve stem 57 by a set screw 61. By this arrangement, rotation of the thimble 60 rotates the valve stem 57 to thread the connecting pin 55 into or out of the threaded hole 56.

As best shown in FIG. 3, in which the thimble 60 is removed from the housing 50 for clarity, the bottom peripheral edge 62 of the thimble 60 is marked with the numbers 0 through 9 at evenly spaced intervals. The outer surface of the top portion of the housing 50 is provided with a scale which is divided into 10 equal parts, with each part having a length equal to the axial movement of the thimble 60 which occurs when the thimble 60 is rotated one full turn. By this arrangement, when the piston 21 is retracted, the axial distance between the valve member 54 and the piston 21 can be precisely adjusted by turning the thimble 60 to a predetermined numbered position on the scales which are provided on the housing 50 and thimble 60.

A shoulder 63 on the valve stem 57 engages an axially aligned shoulder on the housing 50 when the valve stem 57 is rotated in a direction to thread the connecting pin 55 out of the threaded hole 56. This limits the maximum distance that can be provided between the valve member 54 and the piston 21 when the piston 21 is in its retracted position to limit the maximum stroke of the piston 21. The depth of the thread in the threaded hole 56 limits the threading of the connecting pin 55 into the threaded hole 56 to limit the minimum distance between the valve member 54 and the piston 21 when the piston 21 is retracted. This limits the minimum stroke of the piston 21.

A T-shaped return flow passage 64 extends axially and radially through the valve member 54. The return flow passage 64 has a conical valve seat which cooperates with a ball 65 to provide a one way return flow check valve. When the piston 21 is at the end of its stroke so that the valve member 54 engages the valve seat 49 to close the passage 48 and the piston is to be retracted, a decrease in fluid pressure on the pump side of the valve member 54 permits the ball 65 to be unseated in the return flow passage 64 to permit initial return flow of fluid from the chamber 23. After a very small volume of fluid passes through the return flow passage 64, the valve member 54 separates from the valve seat 49 to permit further return flow of fluid from the chamber 23.

As may be seen by reference to FIG. 1, the amount of radial deformation of the end fitting 35 is determined by the distance that the crimping die 31 is pushed into the conical socket 30. This distance may not be the same for different types of end fittings which are to be crimped by any one crimping die. Additionally, when different crimping dies are used for different sizes of hose and end fittings, this distance also changes. According to the present invention, this distance which the crimping die 31 is pushed into the socket 30 is determined by changing the stroke of the piston 21 and pusher member 24.

Prior to the crimping of the end fitting 35, and while the piston 21 is in the fully retracted position shown in FIG. 1, the thimble 60 is rotated to a predetermined position relative to the housing 50 as indicated by the scales on the outer surface of the housing 50 and on the bottom peripheral edge of the thimble 60. For any particular type and size of end fitting that is to be crimped, the proper position of the thimble 60 may be read from a chart (not shown) secured at a convenient location on the crimping machine. Rotating the thimble 60 to this predetermined setting relative to the housing 50 positions the valve member 54 a predetermined position from the valve seat 49. This distance between the conical valving surface of the valve member 54 and the mating conical valving surface of the valve seat 49 determines the stroke of the piston 21.

After setting the thimble 60 to the proper number, the valve 43 is moved to the right and the motor 41 is actuated to operate the pump 40. The pump 40 supplies high pressure fluid through the line 44 to the passage 48 leading to the pressure chamber 23. Because the valve member 54 is spaced from the valve seat 49, this high pressure fluid flows into the pressure chamber 23 and advances the piston 21 axially downwardly against the force of the return spring 26. When the bottom edge of the pusher member 24 engages the top surface of the crimping die 31, the crimping die 31 begins to move axially downwardly into the conical socket 30. This axial advancing of the crimping die 31 into the conical socket 30 displaces the several segments 33 of the crimping die 31 radially inwardly to crimp the hose end fitting 35 onto the flexible hose 36.

This advancing movement of the piston 21 pulls the valve member 54 toward the valve seat 49 by operation of the connecting pin 55. When the valve member 54 engages the valve seat 49, the passage 48 extending into the pressure chamber 23 is closed so that advancing movement of the piston 21 is terminated. Any further increase in fluid pressure on the pump side of the valve member 54 acts on the valve member 54 in a direction to urge the valve member 54 against the valve seat 49.

When this occurs and the relief pressure of the pump is reached, the operator moves the control valve 43 to the left and shuts off the electric motor 41. This connects the upper side of the valve member 54 to the reservoir 42 through the line 44. As pressure on the upper side of the valve member 54 decreases to a pressure less than the pressure in the chamber 23, the ball 65 is unseated to permit fluid flow from the chamber 23 through the return flow passage 64. As the fluid in the chamber 23 returns to the reservoir 42 through the line 44 and the valve 43, the piston return spring 26 moves the piston 21 back toward its retracted position. Because the volume of fluid in the chamber 23 is quite large and the cross sectional area between the valve member 54 and the valve seat 49 is quite small upon initial separation thereof, a high velocity fluid flow between the valve seat 49 and the valve member 54 washes any impurities from the valve seat 49 and valve member 54.

After the piston 21 is fully retracted to the position shown in FIG. 1, the end fitting 35 is removed from the crimping die 31. The machine is then ready to receive the next workpiece (not shown) and to crimp the next workpiece in the manner described above.

What is claimed is:

1. A crimping machine comprising a socket, a crimping die movable axially into and out of said socket, a cylinder, a piston axially movable in said cylinder for effecting said axial movement of said crimping die relative to said socket, said cylinder and said piston cooperatively defining a fluid pressure chamber, a pump, a passage hydraulically connecting said pump and said chamber, a valve member movable relative to said passage to close and open said passage, connecting means including a pin extending between said valve member and said piston maintaining a constant predetermined distance between said valve member and said piston, said connecting means connecting said valve member for axial movement with said piston, and adjusting means for altering said constant predetermined distance including a threaded connection between said pin and said piston.

2. A crimping machine as set forth in claim 1, wherein said valve member and said pin are an integral one piece unit.

3. A crimping machine as set forth in claim 2, including a valve stem and second connection means pivotally connecting said stem and said valve member, whereby axial misalignment of said valve stem and said pin is insufficient to prevent said valve member from closing said passage.

4. A crimping machine comprising a cylinder, a piston axially movable in said cylinder in one direction toward an advanced position and in the other direction toward a retracted position, said cylinder and piston cooperatively defining a fluid pressure chamber, a passage hydraulically connected to said chamber, a valve member in said passage movable between an open position opening said passage and a closed position closing said passage, first means maintaining a constant predetermined distance between said piston and said valve member during axially advancing movement of said piston, second means for changing said predetermined distance when said piston is in said retracted position, and a crimping die axially aligned with said piston.

5. A crimping machine as set forth in claim 4, wherein said first means includes a mechanical element extending between said valve member and said piston, and said second means includes a threaded connection between said mechanical element and said piston and a valve stem extending from said valve member in a direction away from said piston.

6. A crimping machine as set forth in claim 5, wherein said crimping die and said piston and said mechanical element and said valve member and said stem are all disposed in substantial axial alignment.

7. A crimping machine comprising a socket, a crimping die movable axially into and out of said socket, a cylinder, an end plate closing one end of said cylinder, a piston slidably disposed in said cylinder for movement toward and away from said end plate, said cylinder and end plate and piston cooperatively defining a variable volume pressure chamber, a passage extending from side to side completely through said end plate in axial alignment with said piston, a valve seat in said passage in said end plate in axial alignment with said piston, a valve member movable between an open position opening said passage and a closed position closing said passage, a mechanical device connected to said valve member and extending axially from said valve member through said passage and through said pressure chamber to said piston, and a threaded connection connecting said mechanical device to said piston which permits changing the distance between said valve member and said piston by rotating said mechanical device.

8. A crimping machine as set forth in claim 7, including a return flow passage bypassing said valve member and said valve seat when said piston is in said advanced position, and a one way return flow check valve in said return flow passage.

* * * * *